United States Patent [19]

Lenaertz

[11] Patent Number: 4,852,218

[45] Date of Patent: Aug. 1, 1989

[54] PROCESS AND APPARATUS FOR AUTOMATICALLY CHANGING DRUMS WHICH ARE TO RECEIVE WICKS DELIVERED BY TEXTILE MACHINES

[75] Inventor: Pierre J. Lenaertz, Hoelbeck Bilzen, Belgium

[73] Assignee: Societe Anonyme Des Ateliers Houget Duesberg Bosson, Verviers, Belgium

[21] Appl. No.: 179,869

[22] Filed: Apr. 11, 1988

[30] Foreign Application Priority Data

Apr. 13, 1987 [EP] European Pat. Off. ..... 87870050.9

[51] Int. Cl.[4] ..... D04H 11/00

[52] U.S. Cl. ..... 19/159 A

[58] Field of Search ..... 19/159 R, 159 A

[56] References Cited

U.S. PATENT DOCUMENTS

| | | | |
|---|---|---|---|
| 2,988,785 | 6/1961 | Noda | 19/159 A |
| 3,605,198 | 9/1971 | Mackie | 19/159 A |
| 3,808,641 | 5/1974 | Schneider et al. | 19/159 A |
| 4,150,534 | 4/1979 | Raasch | 19/159 A |
| 4,683,619 | 4/1987 | Langen et al. | 19/159 A |

FOREIGN PATENT DOCUMENTS

| | | | |
|---|---|---|---|
| 69087 | 6/1981 | European Pat. Off. | 19/159 A |
| 1036132 | 8/1958 | Fed. Rep. of Germany | 19/159 A |
| 3029737 | 3/1982 | Fed. Rep. of Germany | 19/159 R |
| 395490 | 7/1933 | United Kingdom | 19/159 |

*Primary Examiner*—Werner H. Schroeder
*Assistant Examiner*—Douglas E. Price
*Attorney, Agent, or Firm*—Leonard Bloom

[57] ABSTRACT

A process and apparatus for automatically changing drums which are to receive wicks which are delivered by textile machines. The apparatus includes a translationally movable table. A means for gripping and pulling a wick in a second opposite direction and a means for gripping and severing a pulled wick are provided. At least a portion of both of these means are carried on the table. Positioned thusly, when the table moves in a first direction, that is opposite to the second direction. The table passes under a feeding head that distributes the wick, such that the wick is received on the table and on both of these means. In second position, the one means grips the wick and pulls it in the second opposite direction. Simultaneously, the other means grips and severs the pulled wick. The one means then advances and guides the wick into a drum being filled by the feeding head. Means is also provided for moving the drums in the first direction concomitantly with the movement of the table. Both the table and the means for moving the drum are pivotably mounted for movement between a substantially vertical position and a substantially horizontal position, such that after a drum has been filled and removed, the table and the means for moving the drums can pivot into their respective vertical positions so as to return to their respective first positions.

23 Claims, 7 Drawing Sheets

PROCESS AND APPARATUS FOR AUTOMATICALLY CHANGING DRUMS WHICH ARE TO RECEIVE WICKS DELIVERED BY TEXTILE MACHINES

FIELD OF THE INVENTION

The present invention concerns a process and an apparatus for automatically changing drums which are to receive wicks of fibers coming from textile machines and, more particularly, from carding machines.

BACKGROUND OF THE INVENTION

Carding machines are well known textile machines whose function is to form, starting from disorderly fibers, a thin veil whose fibers are orientated in the direction of their movement in the machine.

This veil is, in certain processes such as those referred to as combed and semi-combed processes, collected in a metal sheet that is in the shape of a funnel to form a ribbon or a wick, whose width is clearly less than that of the veil.

This wick is then, in a classical process well known to those skilled in the art, usually placed in large capacity cylindrical drums by means of a feeding head or feeder.

The wick is placed in a drum being filled by an encircularly moving feeding head, the diameter of whose movements is slightly less than the internal radius of the drum. The circle defined by the movement of the feeding head is very nearly internally tangential to the surface of the drum, in such a way that a small cylindrical portion in the center of the drum remains free from wick. Additionally, the drum is itself moved with a slow movement of rotation.

The wick is therefore deposited in the drum in the form of loops, or successive spirals with each spiral being slightly shifted in relation to the preceeding spiral. These spirals progressively cover the whole periphery of the drum. Then, when the last spiral has performed a complete round, a second layer is deposited, and so on.

During the filling of the drum, another empty drum is waiting, positioned, for example, to the right of the drum being filled. Known means, such as guide rollers are provided to move the drums from the right to the left.

One of the problems encountered during this process is that carding machines have a larger inertia, and are not able to be quickly started or stopped. Thus, any stoppage of the carding machine results in a waste of time, and, thereby an important loss of production.

When the drum in which the wick is deposited is filled, it must be removed and replaced by another drum. For the reason described above, this changing of the drum must take place while the carding machine is operating. The carding machine therefore continues to deliver the wick at the working speed, even though there may not be a drum in place to receive said wick.

The changing of the drum necessitates the presence of a worker when the drum being filled reaches its filling point. This changing of the drum takes a certain amount of time. During this time the wick delivered by the carding machine is deposited on the ground between the filled drum and the new empty drum.

In an attempt to alleviate these disadvantages, systems have been developed in which the changing of the drum is automatically effectuated without the intervention of an operator. In these systems, the filled drum is removed from the feeding head and, simultaneously, an empty drum is positioned in the place from which the filled drum has just been removed.

Unfortunately, no matter how rapidly it is performed, this operation still takes a period of time to complete. Thus, despite the advantages offered by these systems, the changing of the drums can not occur without a certain length of the wick being deposited on the ground between the filled drum and the empty drum.

Another problem encountered by these systems involves severing of the wick once a drum has been filled. If, once a drum has been filled, the wick is not severed, then the rotation of the new drum, exposed the wick coming from the filled drum to becoming "caught" in the process of wick being deposited in the new drum. In such an event, a part of the wick contained in the filled drum becomes unwound and spills out of this filled drum. Additionally, if the part of the wick which has fallen between the two drums is too long, it can get caught in the automatic drum changing mechanism or in the wheels of the drums, which could cause other problems, including losses of time for the operator.

Thus, despite the advantages offered by these systems, an intervention from the operator is then still necessary to break (sever) the wick between the two drums, thereby totally dissociating these two drums. Also, this operation of breaking the wick by the operator keeps the automatic drum changing system from being completely automatic, since a manual operation persists.

All the problems described above are increased by the fact that modern carding machines deliver the wick with an ever increasing linear speed. In this regard, it must be noted that at the elevated process speeds presently practiced —that is, speeds of 400 m/min.—a change of the drum in 3 seconds results in about a fifth of the wick delivered in that time —that is, about 4 meters of wick—falling on the ground between the two drums. Moreover, if the wick is not sectioned immediately, the feeding in the new drum draws not only the wick coming from the feeding head, but also the wick that has already deposited in the old drum, which then will have a tendency to empty itself. Thus, the drums must be changed more and more frequently, even though drum capacity has been increased by an increasing diameter.

Therefore, the operator is required more and more, while a totally automated system would free him from these tasks, allowing him to perform other duties.

Finally, systems have been proposed to avoid the inconveniences described above by automatically breaking the wick between the filled drum and the empty drum and by receiving the wick delivered while the drum changing is taking place. However, these systems are not adapted to the high feeding speeds that are utilized today, for example in the field of the semi-combed processes wherein the wick is fed at speeds reaching 400 m/min. Accordingly, these systems result in a large amount of wick being received on a table and in the subsequent placement in the drum of these large amounts of unwound wick, usually while the drum is being fed additional wick by the feeding head. Such an arrangement results in uneven filling of the drums which wastes storage space and can pose potential problems with knotting of the fibers.

SUMMARY OF THE INVENTION

The present invention aims to equip present feeding heads with a system that avoids the inconveniences described above, by allowing the automatic breaking of the wick between the filled and the empty drum during the operation of a high speed feeding system without a large amount of unwound wick being placed in the drum and without resulting in uneven filing of the drum.

The present invention eliminates these faults, is usable with machines that feed the wick at a high rate of speed, makes the breakage of the wick automatic and prevents the fall of the wick onto the floor. The invention, thereby, also eliminates the need for the presence of the operator close to the feeding head at the time of the changing of the drum.

Between the drums a horizontal table is positioned at the same level as the top edge of the drums. This table is articulated about a horizontal hinge, on the side of the carding machine, in such a way that it can swing downwardly, towards the bottom into a substantially vertical position, permitting a drum to pass in front of it.

This table includes, amongst other things, a tightening block to receive the wick thereon during the changing of the drum, a freely rotating cylindrical roller which is mounted on the table about a substantially horizontal axis, a spring positioned on a vertical axis for constantly urging the free roller upwardly towards the top (towards a driven roller), and a little guide plate that is orientated towards the empty drum.

To the left of drum being filled is positioned a rotating cylindrical roller (a driven roller) that is driven by an motor and a switch which, when it is pushed upwardly towards the top, starts, by an electro-mechanical means, the motor for rotating (driving) the driven roller.

The table comprising the tightening block, the free roller, and the guide plate, as well as guide rollers for moving the drums, are translationally movable from right to left and from left to right, between first and second positions, by means of horizontal sliders. This displacement allows the table to follow the motion of the drums during the replacement of a filled drum by an empty one.

When the drum being filled is filled, a preselection meter counter gives a signal which simultaneously places in motion both the guide rollers and the articulated table.

One of the guide rollers pushes the filled drum towards the left (into a third filled position) and removes it from under the feeding head, while another guide roller pushes the empty drum also towards the left from a first empty position into a second filling position, in such a way as to be substituted for the filled drum. The empty drum then finds itself under the feeding head (the second filling position) where it is filled.

During the translation of the drums, the portion of the wick which has been delivered by the carding machine, is placed along a substantially longitudinal axis on the articulated table which follows this translational movement of the drums. Notably, the wick passes over and is received on, the tightening block, the free roller and the guide plate.

The free roller comes to position itself underneath the roller which is driven by a motor (the driven roller), and applies itself (is urged) against this roller by means of the force of a spring carried by the table, which urges the free roller upwardly towards the top.

Also during the translational movement (of the table in the first direction from the first position to the second position), the tightening block comes to push the switch upwardly towards the top, thereby starting (activating) the motor which drives the driven roller.

The rotation of the driven roller is such that the wick, now pinched between the two rollers, is drawn (pulled) towards the empty drum.

The spirals placed on the articulated table are then unwound and are progressively sent onto the guide plate which guides the wick, so that it falls into the new drum which is being filled.

Additionally, the wick is also pinched by the tightening block, which retains it. When the last spiral placed on the table has been unwound, the wick is tightened by being pulled between the two rollers and the tightening block, until it breaks (severs).

The tension of the wick before this break allows coordination with the starting of an electro-mechanical system which stops the motor of the upper roller when the wick on the table has been pulled and guided into the drum being filled.

In this way, the wick is automatically broken, and no portion of this wick is able to remain between the two drums, the excess of the wick created during the changing of the drum having been sent into the new drum.

After the stoppage of the motor, the articulated table and the guide rollers are swung about their respective hinges into respective substantially vertical positions and are returned, along the horizontal sliders, toward their original positions. Meanwhile, a new drum is then placed in waiting, and the system is ready for the next drum change.

Therefore, in accordance with the teachings of the present invention, there is disclosed an apparatus for automatically replacing, with an empty drum, a drum being filled with spirals of wick exiting from a textile machine of the type having a feeding head that delivers the wick in a continuous manner. The apparatus includes a frame. A translationally movable table is pivotably mounted to the frame about a substantially horizontal axis for pivotal movement between a substantially vertical position and a substantially horizontal position. Means is provided for translationally moving the table along the substantially horizontal axis in a first direction and in a second opposite direction. This movement occurs between a first position, wherein the table is positioned between the drum being filled and the empty drum, and a second position, wherein the table is positioned between the drum being filled and a filled drum. In this fashion, the table translationally moves under the feeding head during the translational movement between the first and second position. Means is provided for selectively pivoting the table between the substantially horizontal position and the substantially vertical position. In this manner, the table is positioned in the horizontal position during translational movement of the table in the first direction, whereby the wick is received thereon along a substantially longitudinal axis, and the table is further positioned in the vertical position during translational movement of the table in the second opposite direction. Means is provided for gripping a wick positioned thereon and for pulling the gripped wick in the second opposite direction along a substantially horizontal plane. In this fashion, the wick is deposited in the drum being filled. Means is also provided for gripping a wick received thereon and for severing the gripped wick when the wick is pulled. Additionally, means is provided for translationally moving the drums in the first direction between a first empty position, a second filling position and a third filled position. The means for gripping and severing and the means for gripping and pulling are each at least partially carried by the table. The respective means are further spaced apart from one another on the table. Wherein, during translational movement of the table in the first direction from the first position to the second position, the wick is delivered by the feeding head. This wick is received on the table along a substantially longitudinal axis and is also received on that portion of the means for gripping and severing carried by the table and that portion of the means for gripping and pulling carried by the table. Finally, in the second position, the means for gripping and pulling grips and pulls the wick in the second opposite direction substantially along the horizontal plane and substantially along the longitudinal axis guiding the wick into the drum being filled, and the means for gripping and severing grips the wick and severs the pulled wick.

These and other objects of the present invention will become apparent from a reading of the following specification, taken in conjunction with the enclosed drawings.

DESCRIPTION OF PREFERRED EMBODIMENTS

Figure 1:
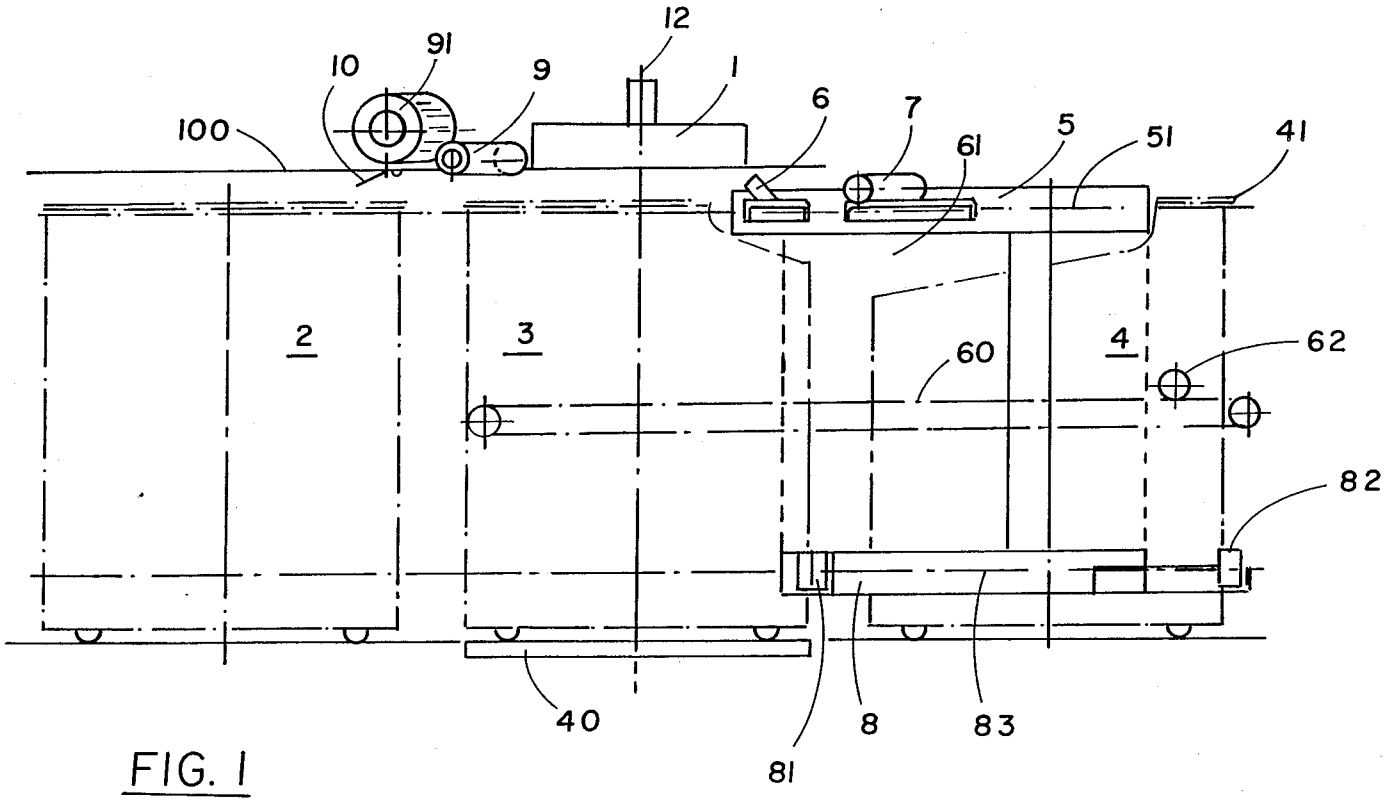
FIGS. 1 to 4 are respective front views illustrating the different phases of the process and the positioning of the apparatus during the changing of the drums.

FIG. 1 shows the encircling feeding head 1, whose principle is well known. Under this feeding head 1 is placed the drum 3 which receives the wick 30. Located to the left of this drum is placed a drum 2, which is filled with wick 30, and which has just been removed by the apparatus. Located to the right of the drum 3 is an empty drum 4, positioned so as to be ready to replace the drum 3 when it is filled.

A horizontal table 5, which includes a tightening block system 6 to retain the wick 30 and a cylindrical roller 7 to draw (grip and pull) the wick 30. This horizontal table is articulatably mounted about a horizontal hinge (not illustrated) whose pivoting axis is shown as 51. Mounted thusly, the table pivots between a substantially vertical position and a substantially horizontal position. Any suitable means may be utilized to pivot the table 5, such as a piston, which are well known to those skilled in the art.

In particular, it is noted that the table 5 of the present invention, is in addition to its unique pivotal and translational movement ability, provided with a unique shape. This shape makes the table particularly useful for this invention by permitting the apparatus to be especially useful in high speed delivery systems. As seen by reference to the drawings, the table 5 is substantially triangular in shape having three edges. At least two of these edges are arcuate in shape (having circular or arcuate cut-outs formed therein). This shape permits the drums to be placed extremely close together, thereby greatly reducing the amount of time required to change the drums and further reducing the overall volume of the apparatus. Further, table 5 is provided with a cut-out portion so that (as will be seen herein) when the table 5 and the guide arms are in their respective vertical positions, one of the guide arms is nested in the cut-out, permitting the vertical positioning of both the table 5 and the guide arms. Thus, the importance of the shape of the table 5 for the successful working of the invention.

A second pivoting system (means for translationally moving the drums in the first direction) 8 includes horizontal (guide) arms, each of which carries a respective guide roller 18 and 82, respectively, for translationally moving (pushing on) both the drum in service 3 and the reserve (the empty) drum 4. The second pivoting system 8 articulates around a horizontal hinge (not illustrated) whose pivoting axis is shown as 83. Preferrably, two such systems 8, one on either side of the drums, is provided. Means for translationally moving this system 8 (and hence the drums) in the first and second directions is also provided. This means includes a substantially horizontal endless conveyor 60 (which, if desired, may be in the form of a chain). The conveyor 60 is driven in the first and the second opposite directions by a suitable electromechanical means 62 which are well known to those skilled in the art. A link (a vertical chariot) 61 is secured between the system 8 and the conveyor 60, such that movement of the conveyor 60 moves the system 8 concomitantly therewith in the first and second opposite directions. The system 8 is guided and supported for this movement by the lower horizontal rail. If desired, this same link (vertical chariot) 61 may also be secured to the table 5, such that the translational movement of the table 5 is precisely coordinated with the system 8. Alternatively, a different link (vertical chariot) may be secured between the table 5 and the conveyor 60, if desired.

To the left of the feeding head 1, fixed to the frame 100 of the machine is a cylindrical roller (driven roller) 9 that is driven by a motor 91 via a belt pulley 93 that is received on the horizontal axes of the roller 9 and the motor 91. This roller 9 is normally in the stop position.

The table 5 and the arms 8 are also mounted for displacement from left to right and from right to left between a right hand position (FIG. 1) and a left hand position (FIG. 2) on horizontal rails, (not illustrated) along the axes shown, respectively, as 51 and 83.

When the drum 3 is filled, a preselection counter gives an electrical signal which starts the sequence. This preselection counter may be any suitable preselection counter, the precise operation and structure of which is well known to those skilled in the art, such as a counter that measures the number of meters of wick 30 being dispensed from the feeding head 1. As is readily understood by those skilled in the art, the preset length of this counter will vary depending on the capacity of the drum being filled.

Table 5 and arms 8 are displaced from right to left (from the right hand position, FIG. 1, to the left hand position, FIG. 2) on their respective rails. The translational movement occurs along axes 51 and 83, respectively. The guide rollers 81 and 82 push, respectively, the drums 3 and 4 towards the left.

Figure 5:
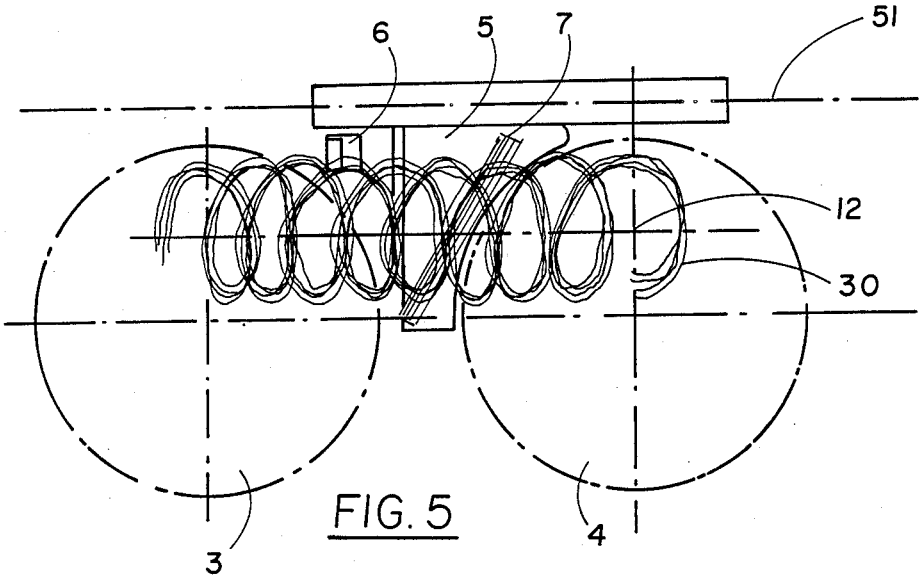
FIG. 5 is an overhead view illustrating the positioning of the spirals between a drum being filled and an empty drum.

During the translation movement of the drums, the feeding head 1 continues moving in an encirculing motion, depositing the wick 30 on the table 5 along a longitudinal axis, in the manner shown in FIG. 5. One can also see in FIG. 5 that the wick 30, in its spiral (encirculing) route, passes over the tightening block 6 and the free roller 7.

When the table 5 reaches the left hand position (FIG. 2), the drum 4 arrives under the feeding head 1, whose center is shown in 12. Placement of the wick 30 into the empty drum 4 then commences.

Figure 6:
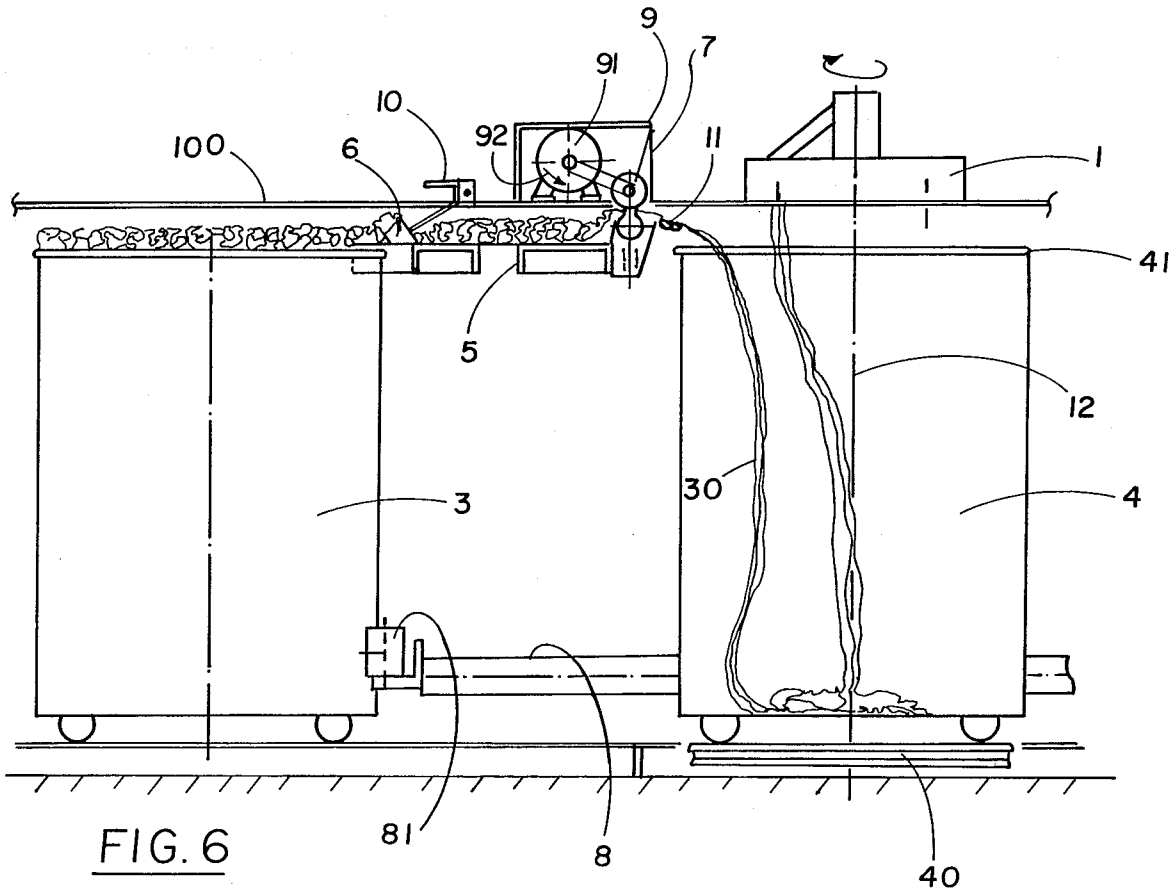
FIG. 6 shows the return of these spirals into the new drum.

It is noted that, in this second filling position, the drum 4 being filled in positioned on a revolving turntable 40 (see, for example, FIG. 6). The revolving movement of this turntable 40 is what permits the wick 30 to be placed in the drum 4 in a peripheral fashion.

Figure 2:
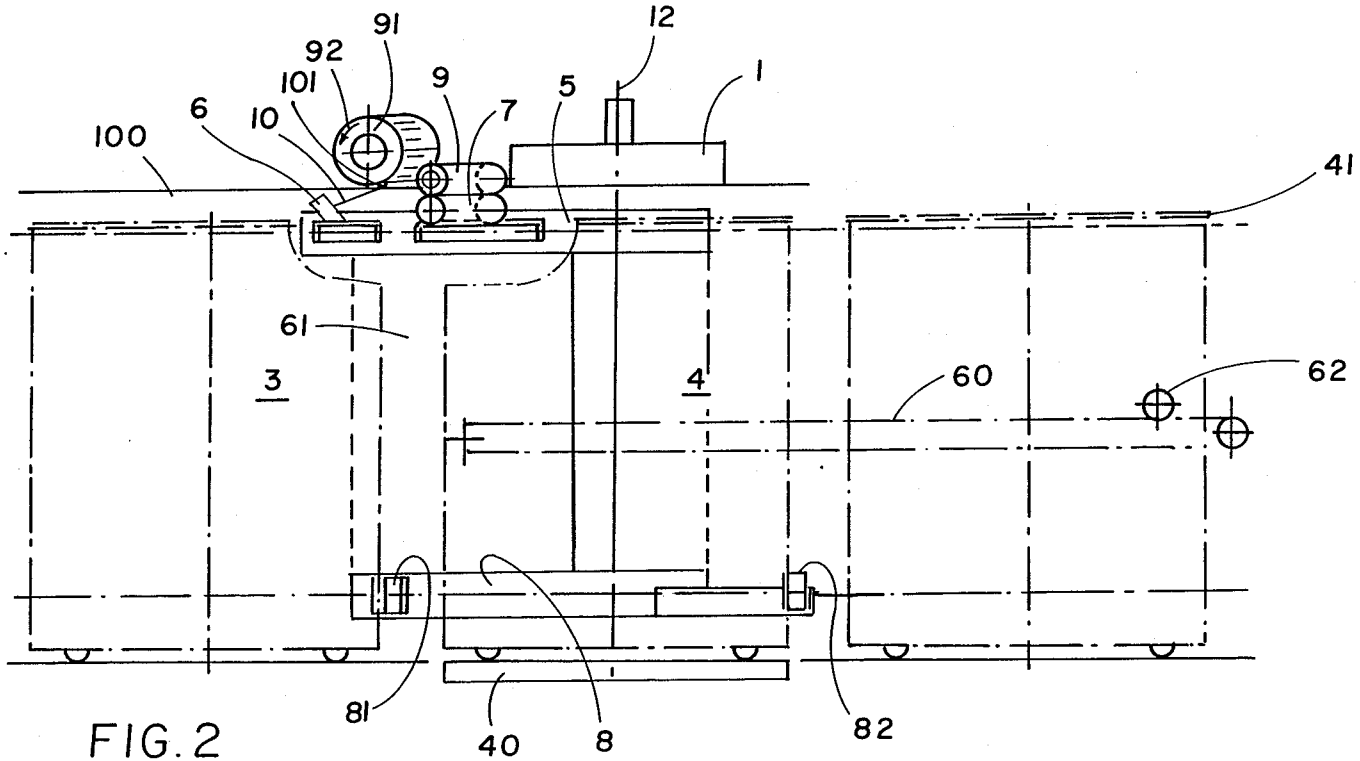

In FIG. 2, one can see that, in the right-to-left translational movement of table 5, the tightening block 6 is brought into contact with a switch 10, which is fixed to the frame 100 of the machine, but which oscillates (pivots) around axis 101. This switch 10 is raised to provide clearance for the tightening block 6 to pass. The switch 10 then pivots about axis 101 falling back onto the back face 20, in relation to the movement of this tightening block 6.

Figure 8:
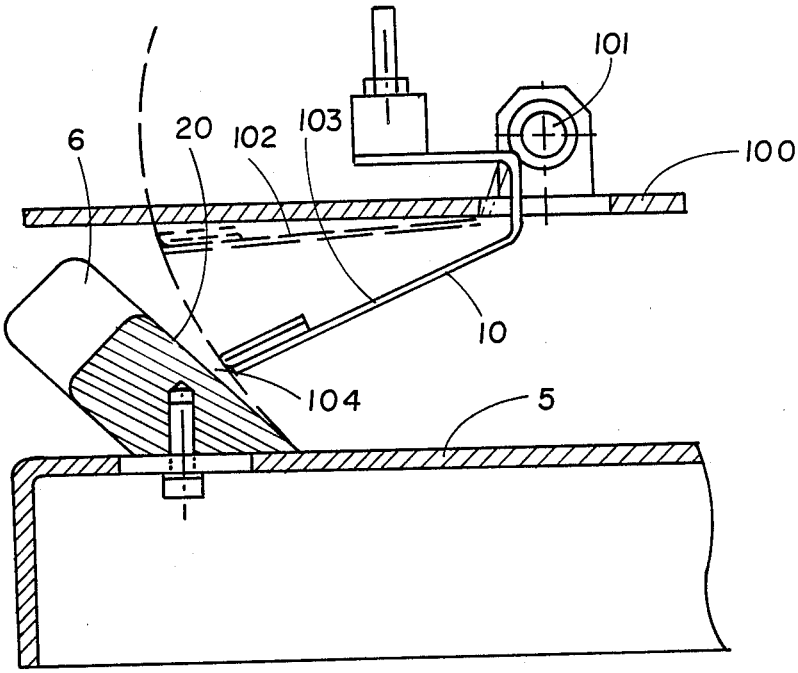
Figure 9:
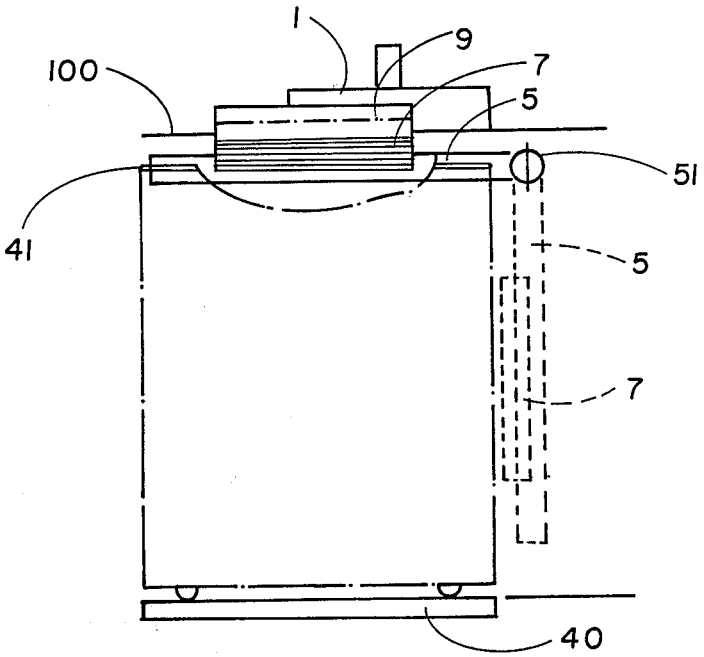
FIG. 9 is a side view of the apparatus of the present invention.

With particular reference now to FIG. 8 there is shown the functioning of the switch 10. As the upper part of the tightening block 6 passes under the switch 10, the block 6 contacts a drop plate (a severing gate) of the switch 10 pushing the drop plate upwardly to the position in dotted lines 102, providing clearance for the block 6 to pass thereunder. Then, as soon as the translational movement of the tightening block 6 from right to left finishes, the block 6 clears the drop plate, permitting the switch 10 to fall back into position 103. The drop plate (severing gate) of the switch 10 stops at a point where the distance 104 between the switch 10 and the tightening block 6 is equal to the thickness of the wick 30 (not illustrated in this figure). In this position 103, the wick 30 is pinched between the severing gate of the switch 10 and the (back face 20 of the) tightening block 6. This pinching of the wick 30 is seen in FIG. 6.

One has to note that, in the FIGS. 6 and 8, any traction (pull) on the wick 30, drawing the wick 30 from left to right, brings about an increase in the tightening (and hence tension) of the wick 30. Such an increase in the tension of the wick 30 draws the switch 10 more downwardly, towards the bottom, and therefore closer to the back face 20 of the tightening block 6, thereby increasing the pinching (severing) force of the gate on the wick 30. This effect provokes, if the traction goes above a certain value, the breaking or the tearing (severing) of the wick 30 substantially at the gate. If desired, a knife or cutting edge (cutting surface) or any other suitable severing means can be carried on the lowermost extremity of the gate in order to effectuate cleaner and more accurate severing of the wick 30.

In FIG. 2, one can see that, in the second position, the free roller 7, which is integral with the table 5, has come to position itself under and against driven roller 9.

Table 5, in its movement towards the left, has also closed the end of an electrical circuit (not illustrated), which starts the motor 91. The rotation of the motor 91 takes place in the direction of the arrow 92. Motor 91 is connected to the driven roller 9 by an endless belt 93, so that this rotation of the motor 91 mechanically draws (drives in a rotational manner) the driven roller 9. By contact between rollers 9 and 7, the rotational movement of the driven roller 9 also draws (rotates) the free roller 7 in the direction of the arrows (see FIG. 7).

As we have seen in FIG. 5, the portion of the wick 30 having been placed (received) on the free roller 7, is pinched between rollers 7 and 9 when the table 5 is in the left hand position (see also FIG. 6). The rotation of these rollers 7 and 9 therefore draws the wick 30 from left to right.

In FIG. 6, one can see that the wick 30 is drawn by rollers 7 and 9, slides on a guide plate 11 which is aligned with the upper edge 41 of a drum being filled, then falls into the empty drum 4 (the drum being filled).

Figure 7:
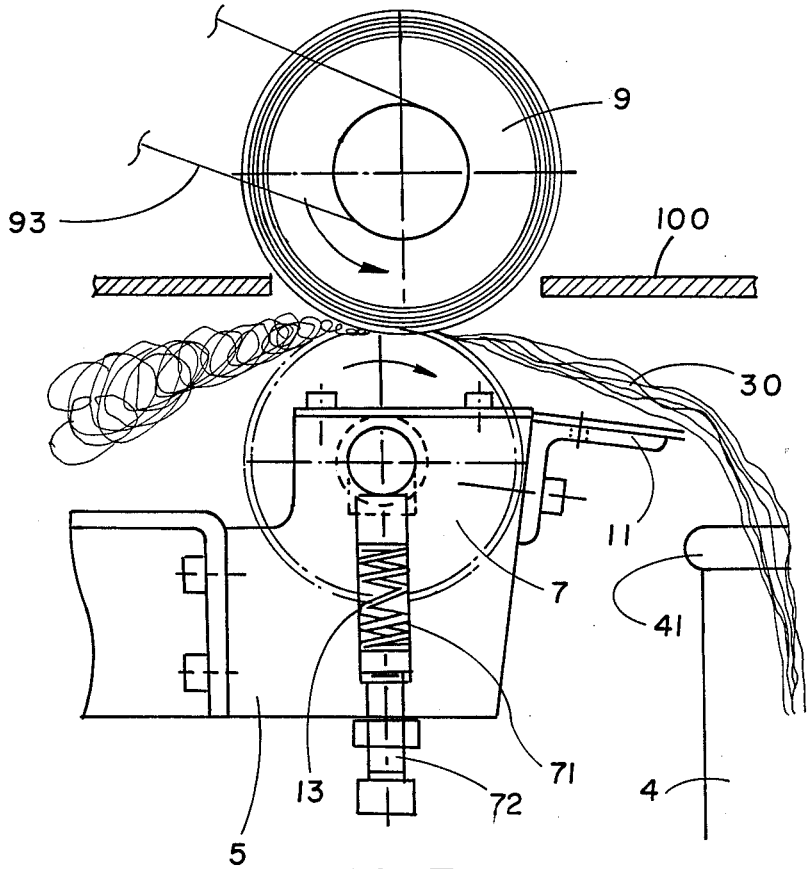
FIGS. 7 and 8 show the details of the system.

In FIG. 7, one sees that roller 7 is applied against (constantly urged against) roller 9 by means of springs 71. Springs 71 are, as illustrated in FIG. 7, carried on the top surface (side) of the table 5. Springs 71 are carried in a sleeve 73 being retained therein by a pair of abutments. The upper abutment contacts the free roller 7 and, being urged upwardly by by the springs 71, in turn, urges the roller 7 upwardly. Bolt adjustment 72 is provided for adjustably increasing and decreasing the tension of the springs 71 for adjusting the force at which the roller 7 is urged upwardly. Preferrably, two such sets of springs 71 are provided. Finally, we also see that the guide plate 11 extends to the top of the edge 41 of the drum 4, such that the plate 11 guides the wick 30 to fall inside this drum 4.

Due to the rotating action of the rollers 7 and 9, all the spirals which are placed on table 5 are unwound as the wick 30 is thereby sent into the empty drum 4. At the end of this process, the wick 30, which, as we have seen in FIG. 8, is pinched between the severing gate of the switch 10 and tightening block 6, is first tightened. Then, under the further traction of the rollers 7 and 9, the wick 30 tears (severs). The extremity of the severed wick 30 on the same side of the severing gate as the rollers 7 and 9 is drawn and guided into the drum 4, the other end remaining pinched between the severing gate of the switch 10 and the (back face 20 of the) tightening block 6.

Figure 3:
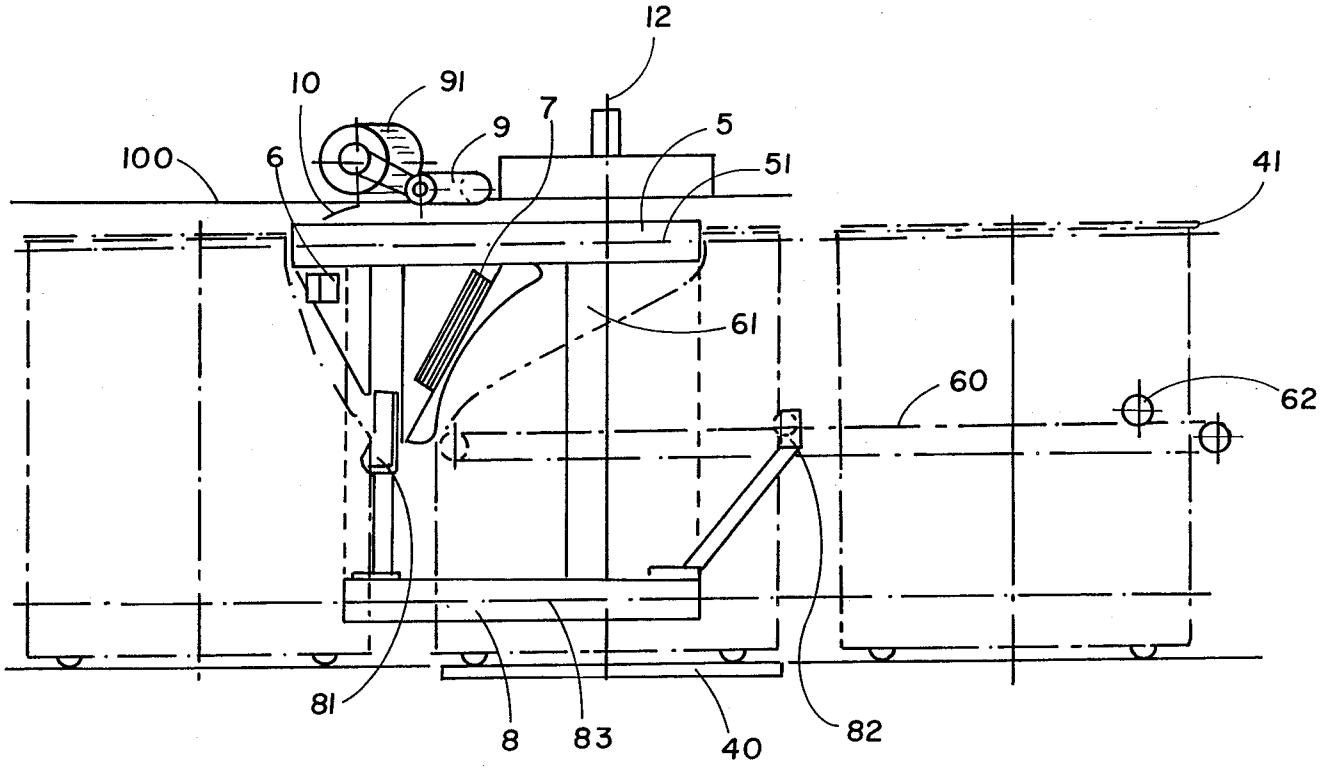

With reference now to FIG. 3, when all the spirals of the severed wick 30 have been sent into the drum 4, the table 5, with the tightening block 6 and the roller 7, pivots downwardly towards the bottom about its axis 51 into its vertical position, and the arms 8, with the guide rollers 81 and 82, pivot upwardly towards the top about their axes 83 and into its vertical position.

Table 5 and the arms 8, with their respective accessories mentioned hereabove, then undergo a left-to-right translation movement from the left hand position (FIG. 3) to the right hand position (FIG. 4) and reclaim the position (the first position) that they had at the beginning of the sequence.

Figure 4:
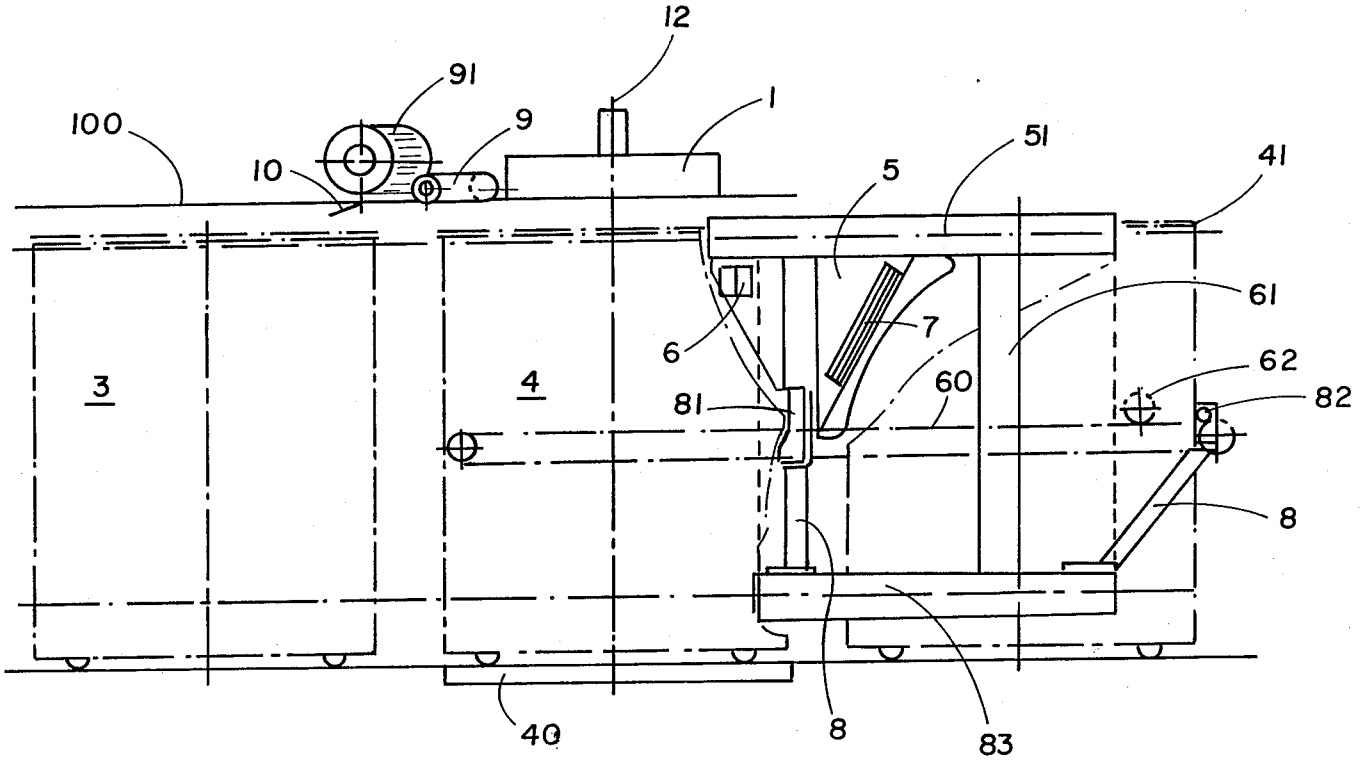

Then, in the position seen in FIG. 4, table 5 pivots upwardly (into the substantially horizontal position), towards the top, about axis 51, and the arms 8 pivot downwardly (into the substantially horizontal position), towards the bottom, about axis 83, to return to the position (the first position) that they had in FIG. 1.

The sequence is thereby terminated, one can see that the changing of drum has been able to be realized without having any part of the wick 30 falling on the ground, between the old and the new drum.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. An apparatus for automatically replacing, with an empty drum, a drum being filled with spirals of wick exiting from a textile machine of the type having a feeding head that delivers the wick in a continuous manner, said apparatus comprised of:

a frame;

a translationally movable table, said table being pivotably mounted to the frame about a substantially horizontal axis for pivotal movement between a substantially vertical position and a substantially horizontal position;

means for translationally moving the table along the substantially horizontal axis in a first direction and in a second opposite direction between a first position, wherein the table is positioned between the drum being filled and the empty drum, and a second position, wherein the table is positioned between the drum being filled and a filled drum, such that the table translationally moves under the feeding head during the translational movement between the first and second positions;

means for selectively pivoting the table between the substantially horizontal position and the substantially vertical position, such that the table is positioned in the horizontal position during translational movement of the table in the first direction, whereby the wick is received thereon along a substantially longitudinal axis, and further such that the table is positioned in the vertical position during translational movement of the table in the second opposite direction;

means for gripping a wick positioned thereon and pulling the gripped wick in the second opposite direction along a substantially horizontal plane, such that the wick is deposited in the drum being filled;

means for gripping a wick received thereon and for severing the gripped wick when the wick is pulled;

means for translationally moving the drums in the first direction between a first empty position, a second filling position and a third filled position;

the means for gripping and severing and the means for gripping and pulling each being at least partially carried by the table, said respective means being spaced apart from one another;

wherein during translational movement of the table in the first direction from the first position to the second position, the wick is delivered by the feeding head, said wick being received on the table along a substantially longitudinal axis, that portion of the means for gripping and severing carried by the table and that portion of the means for gripping and pulling carried by the table; and such that in the second position, the means for gripping and pulling grips and pulls the wick in the second opposite direction substantially along the horizontal plane and substantially along the longitudinal axis guiding the wick into the drum being filled, and the means for gripping and severing grips the wick and severs the pulled wick.

2. The apparatus of claim 1, wherein the movable table is substantially triangular in shape having three edges, two of said edges being arcuately shaped to receive the drums therein.

3. The apparatus of claim 1, wherein the means for translationally moving the table along the horizontal axis is comprised of:

a substantially horizontal rail secured to the frame, said rail carrying the table therewith;

a substantially horizontal endless conveyor;

means for driving the conveyor in the first and second opposite directions; and a link secured between the table and the conveyor, whereby movement of the conveyor moves the table concomitantly therewith for movement in the first and second opposite directions, the table being guided and supported for movement by the horizontal rail.

4. The apparatus of claim 1, wherein the means for gripping and pulling the gripped wick is comprised of;

a motor carried by the frame;

a driven roller mounted on the frame about a substantially horizontal axis for rotational movement, said driven roller secured to the motor for being rotationally driven thereby;

a free roller carried by the table about a substantially horizontal axis for rotational movement, such that in the second position the free roller contacts the driven roller gripping the wick received thereon, and further such that in the second position rotational movement of the driven roller rotationally drives the free roller concomitantly therewith, thereby pulling the wick in the second opposite direction along the substantially horizontal plane.

5. The apparatus of claim 4, wherein the means for gripping and pulling the gripped wick is further comprised of:

at least one spring carried by the table under the free roller for constantly urging the free roller upwardly in contact with the driven roller.

6. The apparatus of claim 1, wherein the means for gripping the wick and for severing the gripped wick when the wick is pulled, is comprised of:

a tightening block carried by the table;

a switch pivotably mounted to the frame about a pivot point above the tightening block, said switch including a severing gate extending downwardly therefrom for pivotal movement between an upper position and a lower gripping and severing position;

wherein the second position the severing gate pivots downwardly towards the tightening block gripping the wick therebetween, such that pulling of the wick in the second opposite direction pulls the severing gate further downwardly for further gripping of the wick therebetween, and further such that further pulling of the wick in the second opposite direction severs the wick gripped between the severing gate and the tightening block substantially at the severing gate.

7. The apparatus of claim 6, wherein the means for severing the gripped wick when the wick is pulled is further comprised of:

a cutting surface carried by the severing gate for contacting the gripped and pulled wick, such that the further pulling of the wick in the second opposite direction severs the wick gripped between the severing gate and the tightening block substantially at the severing gate.

8. The apparatus of claim 6, wherein the switch further includes an upper electrical contact portion, and further wherein during movement of the table between the first and second positions, the tightening block contacts the severing gate pivoting the gate into the upper position and further pivoting the contact portion into contact with the electric motor for activating the motor and rotationally driving the driven roller.

9. The apparatus of claim 1, wherein the means for translationally moving the drums is comprised of:

a lower substantially horizontal rail secured to the frame;

a pair of spaced apart guide arms, said arms being pivotably mounted to the horizontal rail for pivotal movement between a substantially vertical position and a substantially horizontal position;

each of said arms further being movably carried by the horizontal rail for translational movement in the first and the second opposite directions between a first position, wherein the arms embrace an empty drum and a second position, wherein the arms embrace a drum being filled, such that the guide arms are positioned in the horizontal position embracing the drums during translational movement of the arms in the first direction, whereby the drums are moved in the first direction concomitantly therewith, and further such that the guide arms are positioned in the vertical position during translational movement of the table in the second opposite direction;

a substantially horizontal endless conveyor;

means for driving the conveyor in the first and second opposite directions; and a link secured between the guide arms and the conveyor, whereby movement of the conveyor moves the guide arms concomitantly therewith for movement in the first and second opposite directions, the guide arms being guided and supported for movement by the lower horizontal rail.

10. An apparatus for automatically replacing, with an empty drum, a drum being filled with spirals of wick exiting from a textile machine of the type having a feeding head that delivers the wick in a continuous manner, said apparatus comprised of:

a frame;

a translationally movable table, said table being pivotably mounted to the frame about a substantially horizontal axis for pivotal movement between a substantially vertical position and a substantially horizontal position;

means for translationally moving the table along the substantially horizontal axis in a first direction and in a second opposite direction between a first position, wherein the table is positioned between the drum being filled and the empty drum, and a second position, wherein the table is positioned between the drum being filled and a filled drum, such that the table translationally moves under the feeding head during the translational movement between the first and second positions;

means for selectively pivoting the table between the substantially horizontal position and the substantially vertical position, such that the table is positioned in the horizontal position during translational movement of the table in the first direction, whereby the wick is received thereon along a substantially longitudinal axis, and further such that the table is positioned in the vertical position during translational movement of the table in the second opposite direction;

means for gripping a wick positioned thereon and pulling the gripped wick in the second opposite direction along a substantially horizontal plane, such that the wick is deposited in the drum being filled;

means for gripping a wick received thereon and for severing the gripped wick when the wick is pulled;

means for translationally moving the drums in the first direction between a first empty position, a second filling position and a third filled position;

the means for gripping and severing and the means for gripping and pulling each being at least partially carried by the table, said respective means being spaced apart from one another;

wherein during translational movement of the table in the first direction from the first position to the second position, the wick is delivered by the feeding head, said wick being received on the table along a substantially longitudinal axis, that portion of the means for gripping and severing carried by the table and that portion of the means for gripping and pulling carried by the table;

such that in the second position, the means for gripping and pulling grips and pulls the wick in the second opposite direction substantially along the horizontal plane and substantially along the longitudinal axis guiding the wick into the drum being filled, and the means for gripping and severing grips the wick and severs the pulled wick; and wherein the means for translationally moving the table along the horizontal axis includes a substantially horizontal rail secured to the frame, said rail carrying the table therewith, a substantially horizontal endless conveyor, means for driving the conveyor in the first and second opposite directions, and a link movement of the table in the second opposite direction;

means for gripping a wick positioned thereon and pulling the gripped wick in the second opposite direction along a substantially horizontal plane, such that the wick is deposited in the drum being filled said means including a motor carried by the frame, a driven roller mounted on the frame about a substantially horizontal axis for rotational movement, said driven roller secured to the motor for being rotationally driven thereby, a free roller carried by the table about a substantially horizontal axis for rotational movement, such that in the second position the free roller contacts the driven roller gripping the wick received thereon, and further such that in the second position rotational movement of the driven roller rotationally drives the free roller concomitantly therewith, thereby pulling the wick in the second opposite direction along the substantially horizontal plane and at least one spring carried by the table under the free roller for constantly urging the free roller upwardly in contact with the driven roller;

means for gripping a wick received thereon and for severing the gripped wick when the wick is pulled;

means for translationally moving the drums in the first direction between a first empty position, a second filling position and a third filled position;

the means for gripping and severing and the means for gripping and pulling each being at least partially carried by the table, said respective means being spaced apart from one another;

wherein during translational movement of the table in the first direction from the first position to the second position, secured between the table and the conveyor, whereby movement of the conveyor moves the table concomitantly therewith for movement in the first and second opposite directions, the table being guided and supported for movement by the horizontal rail.

11. An apparatus for automatically replacing, with an empty drum, a drum being filled with spirals of wick exiting from a textile machine of the type having a feeding head that delivers the wick in a continuous manner, said apparatus comprised of:

a frame;

a translationally movable table, said table being pivotably mounted to the frame about a substantially horizontal axis for pivotal movement between a substantially vertical position and a substantially horizontal position;

means for translationally moving the table along the substantially horizontal axis in a first direction and in a second opposite direction between a first position, wherein the table is positioned between the drum being filled and the empty drum, and a second position, wherein the table is positioned between the drum being filled and a filled drum, such that the table translationally moves under the feeding head during the translational movement between the first and second positions;

means for selectively pivoting the table between the substantially horizontal position and the substantially vertical position, such that the table is positioned in the horizontal position during translational movement of the table in the first direction, whereby the wick is received thereon along a substantially longitudinal axis, and further such that the table is positioned in the vertical position during translational the wick is delivered by the feeding head, said wick being received on the table along a substantially longitudinal axis, that portion of the means for gripping and severing carried by the table and that portion of the means for gripping and pulling carried by the table; and such that in the second position, the means for gripping and pulling grips and pulls the wick in the second opposite direction substantially along the horizontal plane and substantially along the longitudinal axis guiding the wick into the drum being filled, and the means for gripping and severing grips the wick and severs the pulled wick.

12. An apparatus for automatically replacing, with an empty drum, a drum being filled with spirals of wick exiting from a textile machine of the type having a feeding head that delivers the wick in a continuous manner, said apparatus comprised of:

a frame;

a translationally movable table, said table being pivotably mounted to the frame about a substantially horizontal axis for pivotal movement between a substantially vertical position and a substantially horizontal position;

means for translationally moving the table along the substantially horizontal axis in a first direction and in a second opposite direction between a first position, wherein the table is positioned between the drum being filled and the empty drum, and a second position, wherein the table is positioned between the drum being filled and a filled drum, such that the table translationally moves under the feeding head during the translational movement between the first and second positions;

means for selectively pivoting the table between the substantially horizontal position and the substantially vertical position, such that the table is positioned in the horizontal position during translational movement of the table in the first direction, whereby the wick is received thereon along a substantially longitudinal axis, and further such that the table is positioned in the vertical position during translational movement of the table in the second opposite direction;

means for gripping a wick positioned thereon and pulling the gripped wick in the second opposite direction along a substantially horizontal plane, such that the wick is deposited in the drum being filled;

means for gripping a wick received thereon and for severing the gripped wick when the wick is pulled, said means including a tightening block carried by the table, a switch pivotably mounted to the frame about a pivot point above the tightening block, said switch including a severing gate extending downwardly therefrom for pivotal movement between an upper position and a lower gripping and severing position, wherein in the second position the severing gate pivots downwardly towards the tightening block gripping the wick therebetween, such that pulling of the wick in the second opposite direction pulls the severing gate further downwardly for further gripping of the wick therebetween, and further such that further pulling of the wick in the second opposite direction severs the wick gripped between the severing gate and the tightening block substantially at the severing gate;

means for translationally moving the drums in the first direction between a first empty position, a second filling position and a third filled position;

the means for gripping and severing and the means for gripping and pulling each being at least partially carried by the table, said respective means being spaced apart from one another;

wherein during translational movement of the table in the first direction from the first position to the second position, the wick is delivered by the feeding head, said wick being received on the table along a substantially longitudinal axis, that portion of the means for gripping an severing carried by the table and that portion of the means for gripping and pulling carried by the table; and such that in the second position, the means for gripping and pulling grips and pulls the wick in the second opposite direction substantially along the horizontal plane and substantially along the longitudinal axis guiding the wick into the drum being filled, and the means for gripping and severing grips the wick and severs the pulled wick,

13. An apparatus for automatically replacing, with an empty drum, a drum being filled with spirals of wick exiting from a textile machine of the type having a feeding head that delivers the wick in a continuous manner, said apparatus comprised of:

a frame;

a translationally movable table, said table being pivotably mounted to the frame about a substantially horizontal axis for pivotal movement between a substantially vertical position and a substantially horizontal position;

means for translationally moving the table along the substantially horizontal axis in a first direction and in a second opposite direction between a first position, wherein the table is positioned between the drum being filled and the empty drum, and a second position, wherein the table is positioned between the drum being filled and a filled drum, such that the table translationally moves under the feeding head during the translational movement between the first and second positions;

means for selectively pivoting the table between the substantially horizontal position and the substantially vertical position, such that the table is positioned in the horizontal position during translational movement of the table in the first direction, whereby the wick is received thereon along a substantially longitudinal axis, and further such that the table is positioned in the vertical position during translational movement of the table in the second opposite direction;

means for gripping a wick positioned thereon and pulling the gripped wick in the second opposite direction along a substantially horizontal plane, such that the wick is deposited in the drum being filled;

means for gripping a wick received thereon and for severing the gripped wick when the wick is pulled;

means for translationally moving the drums in the first direction between a first empty position, a second filling position an a third filled position;

the means for gripping and severing and the means for gripping and pulling each being at least partially carried by the table, said respective means being spaced apart from one another;

wherein during translational movement of the table in the first direction from the first position to the second position, the wick is delivered by the feeding head, said wick being received on the table along a substantially longitudinal axis, that portion of the means for gripping and severing carried by the table and that portion of the means for gripping and pulling carried by the table;

such that in the second position, the means for gripping and pulling grips and pulls the wick in the second opposite direction substantially along the horizontal plane and substantially along the longitudinal axis guiding the wick into the drum being filled, and the means for gripping and severing grips the wick and severs the pulled wick; and wherein the means for translationally moving the drums includes a lower substantially horizontal rail secured to the frame, a pair of spaced apart guide arms, said arms being pivotably mounted to the horizontal rail for pivotal movement between a substantially vertical position and a substantially horizontal position, each of said arms further being movably carried by the horizontal rail for translational movement in the first and the second opposite directions between a first position, wherein the arms embrace an empty drum and a second position, wherein the arms embrace a drum being filled, such that the guide arms are positioned in the horizontal position embracing the drums during translational movement of the arms in the first direction, whereby the drums are moved in the first direction concomitantly therewith, and further such that the guide arms are positioned in the vertical position during translational movement of the table in the second opposite direction, a substantially horizontal endless conveyor, means for driving the conveyor in the first and second opposite directions, and a link secured between the guide arms and the conveyor, whereby movement of the conveyor moves the guide arms concomitantly therewith for movement in the first and second opposite directions, the guide arms being guided and supported for movement by the lower horizontal rail.

14. An apparatus for automatically replacing, with an empty drum, a drum being filled with spirals of wick exiting from a textile machine of the type having a feeding head that delivers the wick in a continuous manner, said apparatus comprised of:

a frame;

a translationally movable table, said table being pivotably mounted to the frame about a substantially horizontal axis for pivotal movement between a substantially vertical position and a substantially horizontal position;

means for translationally moving the table along the substantially horizontal axis in a first direction and in a second opposite direction between a first position, wherein the table is positioned between the drum being filled and the empty drum, and a second position, wherein the table is positioned between the drum being filled and a filled drum, such that the table translationally moves under the feeding head during the translational movement between the first and second positions;

means for selectively pivoting the table between the substantially horizontal position and the substantially vertical position, such that the table is positioned in the horizontal position during translational movement of the table in the first direction, whereby the wick is received thereon along a substantially longitudinal axis, and further such that the table is positioned in the vertical position during translational movement of the table in the second opposite direction;

means for gripping a wick positioned thereon and pulling the gripped wick in the second opposite direction along a substantially horizontal plane, such that the wick is deposited in the drum being filled;

means for gripping a wick received thereon and for severing the gripped wick when the wick is pulled;

means for translationally moving the drums in the first direction between a first empty position, a second filling position and a third filled position;

the means for gripping and severing and the means for gripping and pulling each being at least partially carried by the table, said respective means being spaced apart from one another;

wherein during translational movement of the table in the first direction from the first position to the second position, the wick is delivered by the feeding head, said wick being received on the table along a substantially longitudinal axis, that portion of the means for gripping and severing carried by the table and that portion of the means for gripping and pulling carried by the table;

such that in the second position, the means for gripping and pulling grips and pulls the wick in the second opposite direction substantially along the horizontal plane and substantially along the longitudinal axis guiding the wick into the drum being filled, and the means for gripping and severing grips the wick and severs the pulled wick; and wherein the means for translationally moving the drums includes a lower substantially horizontal rail secured to the frame, a pair of spaced apart guide arms, said arms being pivotably mounted to the horizontal rail for pivotal movement between a substantially vertical position and a substantially horizontal position, each of said arms further being movably carried by the horizontal rail for translational movement in the first and the second opposite directions between a first position, wherein the arms embrace an empty drum and a second position, wherein the arms embrace a drum being filled, such that the guide arms are positioned in the horizontal position embracing the drums during translational movement of the arms in the first direction, whereby the drums are moved in the first direction concomitantly therewith, and further such that the g uide arms are positioned in the vertical position during translational movement of the table in the second opposite direction, a substantially horizontal endless conveyor, means for driving the conveyor in the first and second opposite directions, and a link secured between the guide arms and the conveyor, whereby movement of the conveyor moves the guide arms concomitantly therewith for movement in the first and second opposite directions, the guide arms being guided and supported for movement by the lower horizontal rail; and wherein the means for translationally moving the table along the horizontal axis includes a substantially horizontal upper rail secured to the frame, said rail carrying the table therewith, and the link further being secured between the table and the conveyor, whereby being secured between the table and the concomitantly therewith for movement in the first and second opposite directions, the table being guided and supported for movement by the horizontal rail.

15. An apparatus for automatically replacing, with an empty container, a container being filled with wick exiting from a textile machine of the type having a feeding head that delivers the wick in a continuous manner, said apparatus comprised of:

a frame;

a translationally movable table, said table being pivotably mounted to the frame about a substantially horizontal axis for pivotal movement between a substantially vertical position and a substantially horizontal position;

means for translationally moving the table along the substantially horizontal axis in a first direction and in a second opposite direction between a first position, wherein the table is positioned between the container being filled and the empty container, and a second position, wherein the table is positioned between the container being filled and a filled container, such that the table translationally moves under the feeding head during the translational movement between the first and second positions;

means for selectively pivoting the table between the substantially horizontal position and the substantially vertical position, such that the table is positioned in the horizontal position during translational movement of the table in the first direction, whereby the wick is received thereon along a substantially longitudinal axis, and further such that the table is positioned in the vertical position during translational movement of the table in the second opposite direction;

means for gripping a wick positioned thereon and pulling the gripped wick in the second opposite direction along a substantially horizontal plane, such that the wick is deposited in the container being filled;

means for gripping a wick received thereon and for severing the gripped wick when the wick is pulled;

means for translationally moving the containers in the first direction between a first empty position, a second filling position and a third filled position;

the means for gripping and severing and the means for gripping and pulling each being at least partially carried by the table, said respective means being spaced apart from one another;

wherein during translational movement of the table in the first direction from the first position to the second position, the wick is delivered by the feeding head, said wick being received on the table along a substantially longitudinal axis, that portion of the means for gripping and severing carried by the table and that portion of the means for gripping and pulling carried by the table; and such that in the second position, the means for gripping and pulling grips and pulls the wick in the second opposite direction substantially along the horizontal plane and substantially along the longitudinal axis guiding the wick into the container being filled, and the means for gripping and severing grips the wick and severs the pulled wick.

16. An apparatus for automatically replacing a drum having a top edge and filled with spirals of fiber wick with an empty drum having a top edge at the exit of a textile machine of the type equipped with a feeding head which delivers the wick in a continuous manner during replacement of the drums, said apparatus comprising of:

a frame;

means for translationally moving the drums in a first direction between a first empty position, a second filling position and a third filled position;

a mobile table positioned for translational movement in the first direction and a second opposite direction between a first position, wherein the table is positioned between the empty drum and the drum being filled and a second position, wherein the table is positioned between the drum being filled and a filled drum being removed from the device, said mobile table being pivotably mounted to the frame about a substantially horizontal axis for pivotal movement between a first horizontal position, wherein the table is positioed substantially at the level of the top edge of the drums and a second vertical position;

wherein during translational movement of the table in the first direction from the second position to the first position, the wick is received on the table;

tightening means for gripping the wick received thereon and for severing a pulled wick gripped thereby, a portion of said tightening means being carried by the table, such that during translation movement of the table in the first direction, the wick from the feeding head is received on the tightening means being gripped thereby;

means for pulling the gripped wick in the second opposite direction, such that the gripped and pulled wick is severed by the tightening means.

17. The apparatus of claim 16, wherein the tightening means is further comprised of:

an inclined tightening block integral with the mobile table;

an pivoting switch secured to the frame about a pivot point for pivotal movement between an upper position and a lower gripping and severing position;

wherein when the table is in the second position, the pivoting switch pivots downwardly twoards the tightening block gripping the wick therebetween, such that pulling of the wick in the second opposite direction pulls the pivoting switch further downwardly for further gripping of the wick therebetween, and further such that further pulling of th ewick in the second opposite direction severs the wick gripped between the pivoting switch and the tightening block substantially at the pivoting switch.

18. The apparatus of claim 16, wherein the means for pulling the gripped wick in the second opposite direction is comprised of:

a motor carried by the frame;

a free roller carried by the table about a substantially horizontal axis for rotational movement;

a driven roller mounted on the frame about a substantially horizontal axis for rotational movement, such that in the second position the free roller contacts the driven roller gripping the wick received thereon, and further such that in the second position rotational movement of the driven roller rotationally drives the free roller concomitantly therewith, thereby pulling the wick in the second opposite direction along a substantially horizontal plane.

19. The apparatus of claim 18, further comprised of:

at least one spring carried by the table below the free roller for constantly urging the free roller upwardly against the driven roller.

20. The apparatus of claim 18, further comprised of:

an electric circuit for providing electric power to the motor for driving the driven roller.

21. The apparatus of claim 16, further comprised of:

a lateral hinge for pivotably mounting the table to the frame.

22. The apparatus of claim 16, further comprised of:

a substantially horizontal rail carried by the frame; and means for securing the table to the rail, whereby the table may be translationally moved between the first and second positions.

23. A process for automatically replacing a drum filled with spirals of wick with an empty drum at the exit of a textile machine of the type equipped with a feeding head which delivers the wick in a continuous manner during replacement of the drums, said process comprised of the steps of:

translationally moving a table in a first direction during the changing of the drums, such that the wick delivered by the feeding head is received on the table along a substantially longitudinal axis;

gripping a portion of the wick received on the table during the translational movement thereof;

pulling the gripped wick in a second opposite direction towards the drum being filled, so that the fiber wick is severed and is deposited in the drum being filled.

* * * * *

UNITED STATES PATENT AND TRADEMARK OFFICE

CERTIFICATE OF CORRECTION

PATENT NO. : 4,852,218

DATED : August 1, 1989

INVENTOR(S) : Lenaertz

It is certified that error appears in the above-identified patent and that said Letters Patent is hereby corrected as shown below:

Column 2, line 14, "exposed" should be -- exposes --.

Column 7, line 13, "in" should be -- is --.

Column 10, line 47, after "wherein" and before "the", insert therein -- in --.

Column 12, line 37 through Column 13, line 3, after "link" and before "secured", delete in its entirety.

Column 13, line 36, after "translational" and before "the", insert -- movement of the table in the second opposite direction;

means for gripping a wick positioned thereon and pulling the gripped wick in the second opposite direction along a substantially horizontal plane, such that the wick is deposited in the drum being filled said means including a motor carried by the frame, a driven roller mounted on the frame about a substantially horizontal axis for rotational movement, said driven roller secured to the motor for being rotationally driven thereby, a free roller carried by the table about a substantially horizontal axis for rotational movement, such that in the second position the free roller contacts the driven roller gripping the wick received thereon, and further such that in the second position rotational movement of the driven roller rotationally drives the free roller concomitantly therewith, thereby pulling the wick in the second opposite direction along the substantially horizontal plane and at least one spring carried by the table under the free roller for constantly urging the free roller upwardly in contact with the driven roller;

means for gripping a wick received thereon and for severing the gripped wick when the wick is pulled;

means for translationally moving the drums in the first direction between a first empty position, a second filling position and a third filled position;

the means for gripping and severing and the means for gripping and pulling each being at least partially carried by the table, said respective means being spaced apart from one another;

UNITED STATES PATENT AND TRADEMARK OFFICE

CERTIFICATE OF CORRECTION

PATENT NO. : 4,852,218

DATED : August 1, 1989

INVENTOR(S) : Lenaertz

It is certified that error appears in the above-identified patent and that said Letters Patent is hereby corrected as shown below:

wherein during translational movement of the table in the first direction from the first position to the second position, --

Column 14, line 50, "an" should be -- and --.

Column 17, line 21, "g uide" should be -- guide --.

Column 17, lines 37-38, after "whereby" and before "concomitantly", delete "being secured between the table and the" and insert therefore -- movement of the conveyor moves the table --.

Column 18, line 56, "positioed" should be -- positioned --.

Column 19, line 12, "twoards" should be -- towards --.

Column 19, line 17, "th" should be -- the --.

Column 19, line 18, "ewick" should be -- wick --.

Signed and Sealed this

Thirteenth Day of March, 1990

*Attest:*

JEFFREY M. SAMUELS

*Attesting Officer*

*Acting Commissioner of Patents and Trademarks*